US006612450B1

(12) United States Patent
Buono

(10) Patent No.: US 6,612,450 B1
(45) Date of Patent: Sep. 2, 2003

(54) REVERSIBLE CAP

(75) Inventor: Caetano Buono, Brooklyn, NY (US)

(73) Assignee: Van Blarcom Closures, Inc., Brooklyn, NY (US)

( * ) Notice: Subject to any disclaimer, the term of this patent is extended or adjusted under 35 U.S.C. 154(b) by 149 days.

(21) Appl. No.: 09/801,338

(22) Filed: Mar. 7, 2001

(51) Int. Cl.[7] ..... B65D 50/08

(52) U.S. Cl. ..... 215/228; 215/225; 220/281; 220/326

(58) Field of Search ..... 215/209, 213, 215/214, 216, 224, 225, 228, 245, 317, 321; 220/326, 281, 212

(56) References Cited

U.S. PATENT DOCUMENTS

| | | | | |
|---|---|---|---|---|
| 3,101,856 | A | 8/1963 | Whiteman, Jr. | |
| 3,642,161 | A | 2/1972 | Stroud | |
| 3,703,975 | A | 11/1972 | Wittemer | |
| 4,029,231 | A | 6/1977 | Jonsson | |
| 4,103,797 | A | 8/1978 | Morris | |
| 4,127,221 | A | 11/1978 | Vere | |
| 4,314,656 | A | 2/1982 | Kessler | |
| 4,393,976 | A | 7/1983 | Maguire | |
| 4,406,376 | A | 9/1983 | Berghahn | |
| 4,420,089 | A | 12/1983 | Walker et al. | |
| 4,480,762 | A | 11/1984 | Thomas | |
| 4,511,049 | A | 4/1985 | Aboud | |
| 4,526,281 | A | 7/1985 | Herr | |
| 4,573,599 | A | 3/1986 | Fillmore | |
| 4,752,013 | A | 6/1988 | Miller et al. | |
| 4,854,459 | A | 8/1989 | DeJonge | |
| 5,040,694 | A | 8/1991 | Gambello | |
| 5,147,052 | A | 9/1992 | Minette | |
| 5,147,053 | A | 9/1992 | Priedenthal | |
| 5,316,161 | A | 5/1994 | Gargione | |
| 5,370,251 | A | 12/1994 | Buono | |
| 5,394,999 | A | 3/1995 | Krall | |
| 5,449,077 | A | 9/1995 | Seidler | |
| 5,566,864 | A | 10/1996 | Stolz | |
| 5,588,545 | A | 12/1996 | King | |
| 5,615,787 | A | 4/1997 | Morris, Sr. | |
| 5,636,756 | A | 6/1997 | Johnson | |
| 5,740,933 | A | 4/1998 | Conti et al. | |
| 5,865,330 | A | 2/1999 | Buono | |
| 5,893,473 | A | 4/1999 | Morris, Sr. | |
| 5,941,402 | A | 8/1999 | Krueger | |
| 6,029,834 | A | 2/2000 | Sanner | |
| 6,039,196 | A | 3/2000 | Ekkert et al. | |
| 6,085,920 | A | 7/2000 | Moretti | |
| 6,161,711 | A | 12/2000 | Miceli et al. | |
| 6,439,409 | B1 * | 8/2002 | Dressel et al. | 215/228 |
| 2001/0035388 | A1 * | 11/2001 | Miceli et al. | 215/228 |

* cited by examiner

*Primary Examiner*—Nathan J. Newhouse
(74) *Attorney, Agent, or Firm*—Cohen, Pontani, Lieberman & Pavane

(57) ABSTRACT

A cap and container for providing a child resistant closure by engaging one side of the cap with the container, and providing a non-child resistant closure by engaging another side of the cap with the container. The child resistant closure includes a wall and a bounding outer skirt having a tab formed therein. A pair of tangs are supported on a distal end of the tab on the child resistant closure side of the cap. The tangs engage a lip formed on a mouth flange of the container when the child resistant closure side of the cap is forced against the flange, for engaging the tang with the lip and securing the cap to the container. An inner skirt formed on the non-child resistant closure side of the cap is spaced from the outer skirt to form a friction fit with the mouth flange.

10 Claims, 7 Drawing Sheets

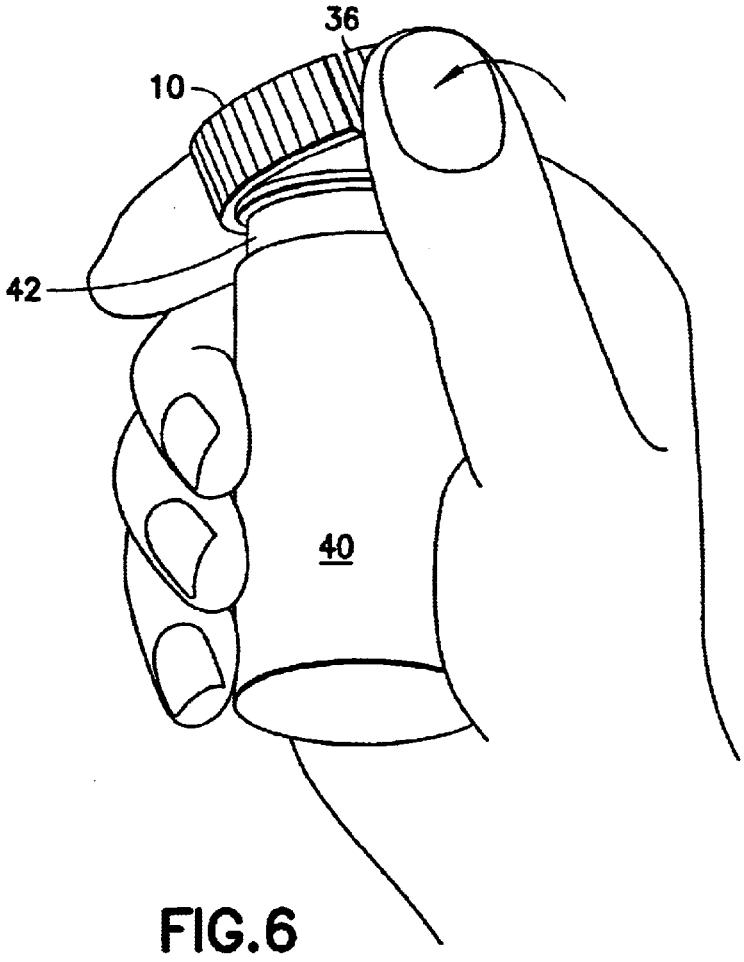
FIG.6
FIG.7
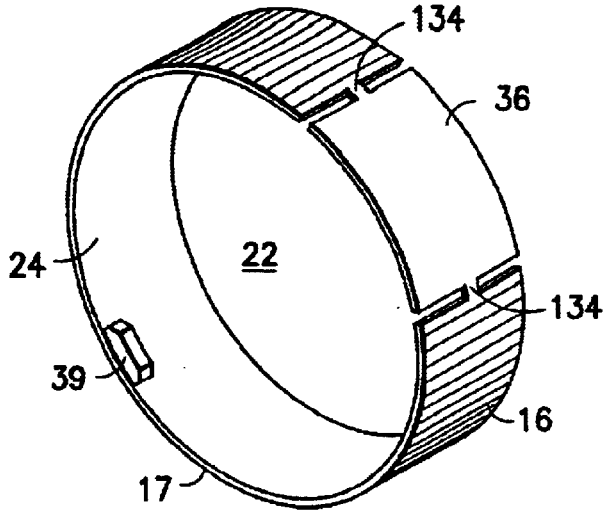

REVERSIBLE CAP

BACKGROUND OF THE INVENTION

1. Field of the Invention

The invention is directed to a child-resistant cap and container and, more particularly, to a cap having a child resistant closure on one side and a non-child resistant closure on another side, with both closures being capable of engaging a container.

2. Description of the Related Art

Numerous child-resistant mechanisms for preventing access to containers storing dangerous substances such as medicine, household cleaners, poisons or the like are known. Most, however, are complicated in design which drives up the cost of manufacturing the caps and containers. Also, typical child-resistant containers are often difficult to open as they require a user to exert an appreciable amount of force while simultaneously engaging in a sequence of complex manipulative movements to release the cap closure mechanism. Such exertion, even for small containers (such as pill bottles) require two-handed manipulation of the closure and cap by the user. For these reasons, many child-resistant mechanisms are unsuitable for physically feeble persons such as the elderly and the sick.

For example, U.S. Pat. Nos. 3,989,152 and 4,149,646 to Julian disclose a child-resistant cap having a tab provided in the bottom of the skirt of the cap, and a container having an abutment disposed at the neck of the container for locking engagement with the tab. A user is required to squeeze or flex the entire skirt while twisting the cap off so as to deflect the tab inward and around the abutment at the container neck. Such squeezing action would require an appreciable amount of force which may not be available to a physically feeble user.

Another example, U.S. Pat. No. 4,413,742 to Sandhaus discloses a cap having a tab that is frictionally receivable in a recess defined in the neck of the container. To remove the cap, the user is required to push out the hinged tab by, for example, depressing the top of the cap. To reinstall the cap over the container, the user must thread the cap onto the container neck and realign the tab with the recess in the neck.

In still another example, U.S. Pat. No. 4,752,014 to House et al. discloses a child-resistant closure having a ratchet type mechanism. The cap includes a tab notched in the depending skirt of the cap. The tab is movable in the radially outward direction and has a pawl extending from a bottom surface of the tab. A plurality of recesses are formed at the neck of the container for receiving the pawl. Thus, as a user threads the cap onto the container neck, the pawl is brought into ratchet engagement with the recesses in the neck. To open the container, a user is required to pivot the tab and the pawl radially outwardly so as to remove the pawl from the recess received therein. This ratchet type mechanism is complex in design and expensive to manufacture. Furthermore, this design does not provide the requisite positive locking unless the user screws the cap on with adequate force so that the pawl is sufficiently received in one of recesses.

Other child-resistant closures are disclosed in U.S. Pat. No. 5,449,077 Seidler; U.S. Pat. No. 6,161,711 Miceli et al; U.S. Pat. No. 4,480,762 Thomas; U.S. Pat. No. 5,740,933 Conti et al; U.S. Pat. No. 4,406,376 Berghahn; U.S. Pat. No. 5,636,756 Johnson; U.S. Pat. No. 4,103,797 Morris; U.S. Pat. No. 4,752,013 Miller et al.; U.S. Pat. No. 3,703,975 Wittemer; U.S. Pat. No. 4,573,281 Fillmore; U.S. Pat. No. 3,642,161 Stroud; U.S. Pat. No. 4,526,281 Herr; U.S. Pat. No. 5,460,281 Rapchak et al.; and U.S. Pat. No. 4,752,013 Miller et al. While some of these patents disclose reversible caps, none teaches the use of a safety cap having a single tab for one-hand manipulation, or a reversible snap-cap having a child safety closure and a non-child safety closure incorporating the structure of the present invention.

SUMMARY OF THE INVENTION

The present invention is directed to a reversible cap for engaging a container. The container has a body and a neck defining a mouth, with a flange formed at the mouth of the container. The reversible cap has a child resistant closure formed on a first side, and a non-child resistant closure formed on a second side, which closures are segregated from each other by a dividing wall positioned between the child resistant and non-child resistant closures. An outer skirt bounds the dividing wall and includes a fixed tang mounted proximate an edge of the outer skirt on the first side of the cap. The fixed tang extends radially inward toward the center of the cap. A portion of the outer skirt defines a tab having a first end and a second end. The tab is pivotally connected to the outer skirt to provide for outward radial movement of the first end relative to the outer skirt upon application of a pushing force to the second end of the tab. The tab includes moveable tangs mounted proximate the first end of the tab which extend radially inward toward the center of the cap. The fixed and moveable tangs are releasably engageable with the flange when the child resistant closure is positioned over the mouth and forced against the flange.

In a preferred embodiment, an inner skirt is attached to the dividing wall and disposed on the second side of the cap radially displaced from the outer skirt to form a receiving area between the outer skirt and the inner skirt. The receiving area forms a friction fit with the flange when the non-child resistant closure is positioned over the mouth and forced against the flange.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

In the drawings, wherein like reference characters denote similar elements throughout the several views:

FIG. 6 depicts a one-hand operation of the inventive cap by a user; and

FIG. 7 depicts another embodiment of the reversible cap.

DETAILED DESCRIPTION OF THE PRESENTLY PREFERRED EMBODIMENTS

Figure 1A:
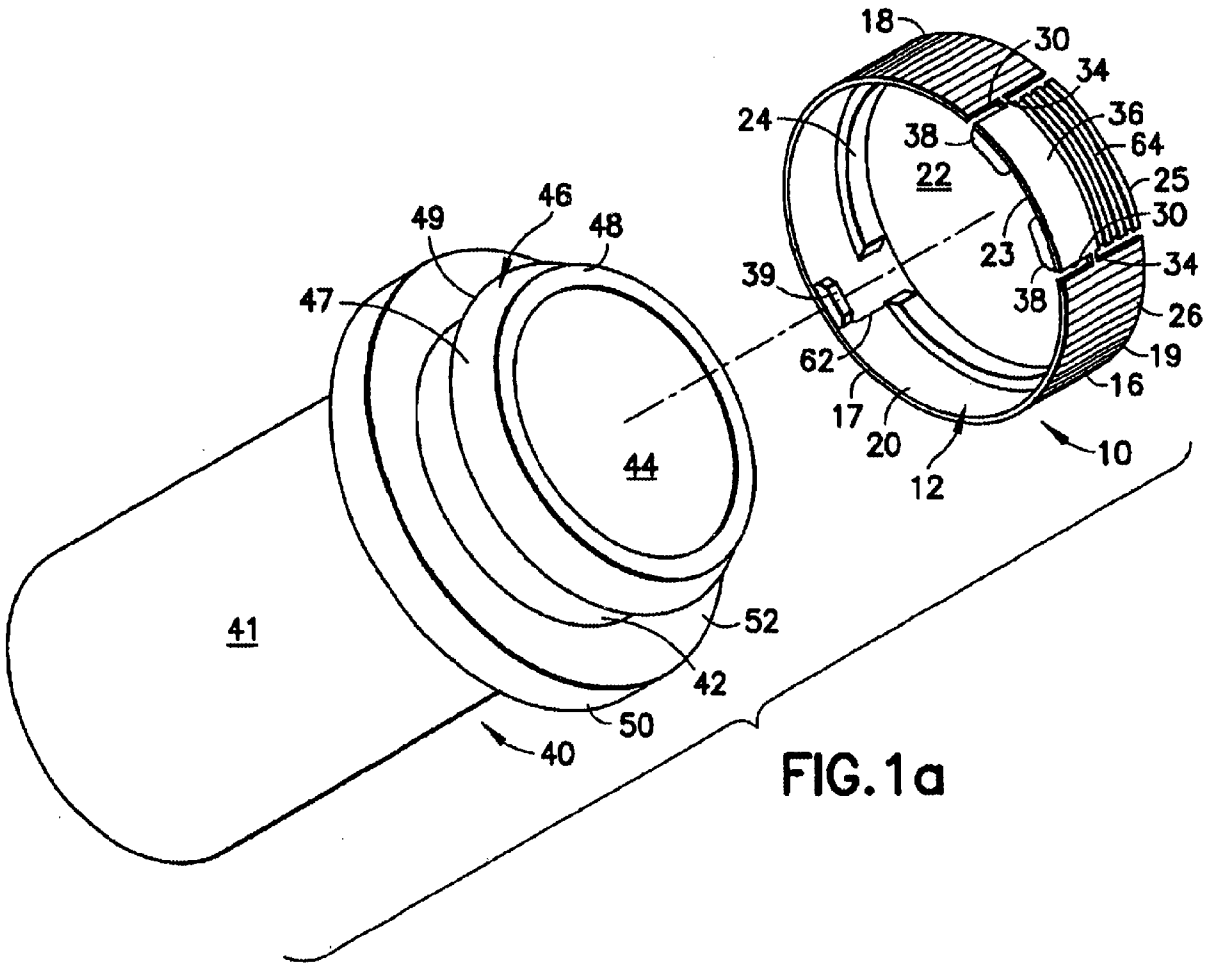
FIG. 1*a* is a perspective view of an embodiment of the reversible cap and container, depicting a child resistant enclosure of the cap constructed in accordance with the present invention.
Figure 1B:
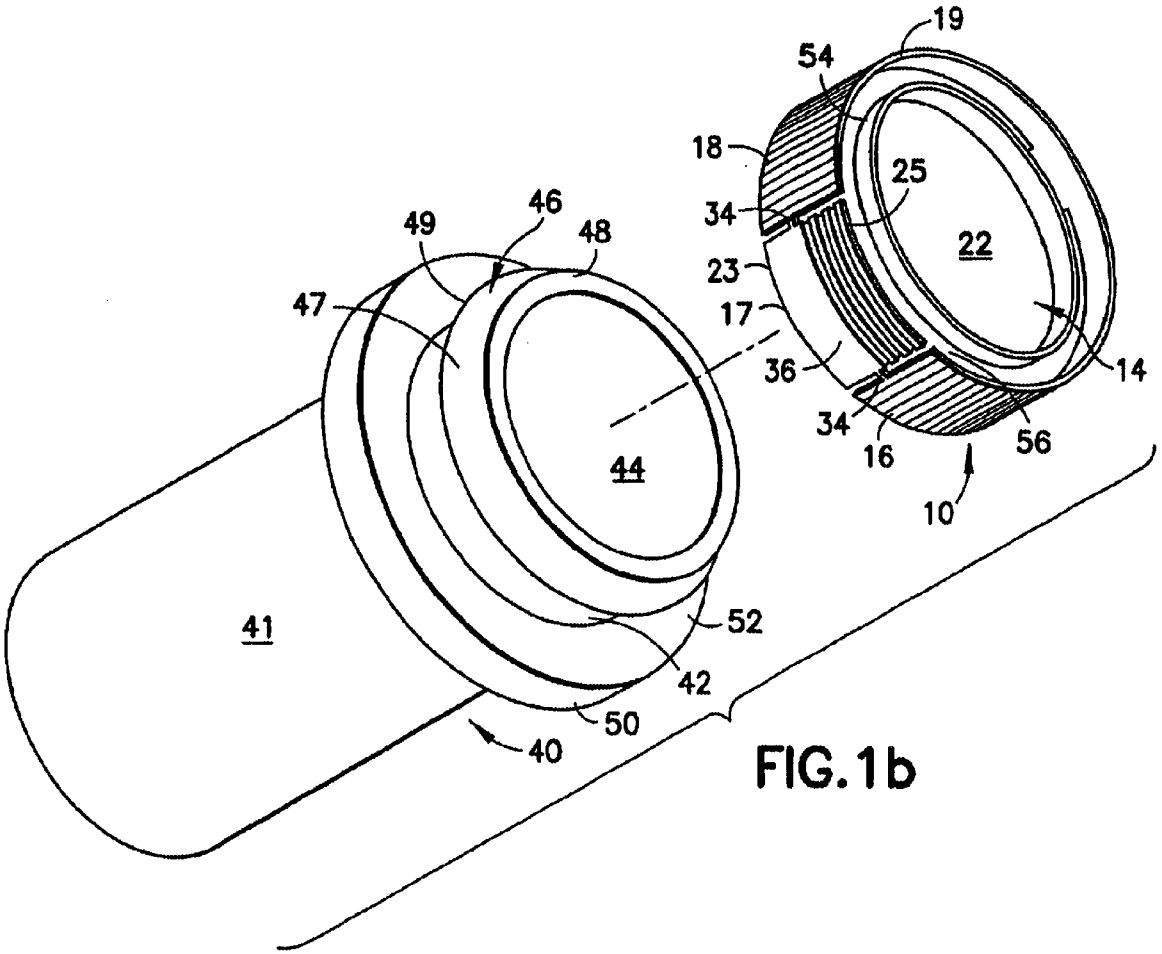
FIG. 1*b* is a perspective view of an embodiment of the reversible cap and container, depicting a non-child resistant enclosure of the cap constructed in accordance with the present invention.

A closure in accordance with an illustrative embodiment of the present invention is shown in FIGS. 1*a* and 1*b* and includes a cap 10 and a container 40. The cap and container are designed to provide a non-threaded, snap-fit coupling therebetween to enclose contents, such as pharmaceuticals, within the container 40. The cap 10 is configured to provide two types of closures, namely, a child resistant closure 12 (shown in FIG. 1*a*) and a non-child resistant closure 14 (shown in FIG. 1*b*). The closures are separated from each other by a dividing wall 22 which serves to cover the mouth of the container 40 and which is bounded by and connected to an outer skirt 16 having a first end 17 on the child resistant closure side of the cap and a second end 19 on the non-child resistant closure side of the cap. The outer skirt is preferably integrally formed with the wall 22 and has outer surface 18 and an inner surface 20, with textured ribs 26 formed on the outer surface to facilitate gripping of the cap by a user.

Figure 5:
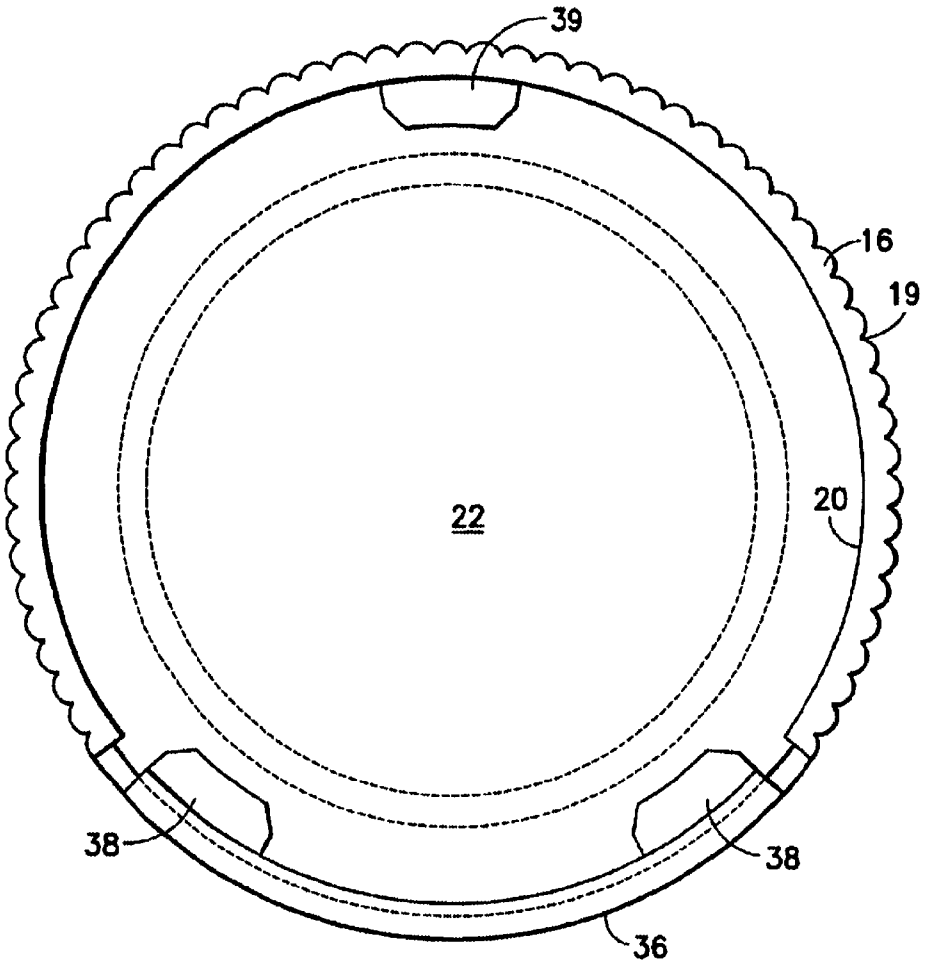
FIG. 5 depicts a bottom plan view of the child resistant closure cap in accordance with a preferred embodiment of the present invention.

With continued reference to FIG. 1*a*, cap 10 has a pair of longitudinal slots 30 formed in the outer skirt 16 and extending from ends 17 and 19 which define a tab 36. The tab is separated from the skirt 16 by the slots but remains connected to the cap via connection to the dividing wall, i.e. via connection to a portion of the dividing wall along a rear surface of the tab 36. This connection forms a flexible joint or fulcrum 34 about which the tab 36 pivots. As shown in FIG. 1*a*, the tab has a first end 23 coterminous with end 17 of the outer skirt, and a second end 25 coterminous with end 19 of the outer skirt, and supports one or more tangs 38 which are mounted to the inner surface of the tab proximate the first end 23. The tangs 38 extend radially inwardly, as shown, and are movable with the tab 36 such that when a squeezing force is applied to the second end 25 of the tab for pivoting the tab about its fulcrum 34, the tangs 18 move radially outward as shown in FIG. 2*b*. One or more fixed tangs 39 is provided on the inner surface of the skirt 16 opposite tangs 38 and proximate the first end 17 which, like tangs 38, extends radially inwardly. A preferred positioning of tangs 38 and 39 is shown in FIG. 5. In an alternate embodiment, an inner skirt 24 integral with the inner surface 20 of outer skirt 16 and adjacent to the wall 22 is provided, which, along with fixed tang 39, defines an engagement region 62 for mating with the container 40 as explained below. The cap and, in particular, the outer skirt 16 is preferably made of a flexible material (e.g., plastic, etc.) having memory such that when the tab 36 is pivoted about its fulcrum, it will return to an initial or rest position (shown in FIG. 1) when the pivoting force is removed.

It will be readily appreciated by those skill in the art the tab 36 can be, alternatively, pivotally attached to the outer skirt instead of or in addition to the wall 22 such as by forming the slots 30 in an appropriate manner to form a pair of connection hinges that are axially aligned with the outer surface 18 of the outer skirt 16 (as shown in FIG. 7).

The container 40 includes a hollow body 41 for holding contents (e.g., pills, etc.), and a neck region 42 defining a mouth 44. The neck 42 is bounded by a flange 46 positioned proximate the mouth 44, and an annular shelf 50 having an upper surface 52. The flange 46 has an outer surface 47 that is tapered outwardly from a first end 48 to a second end 49. In a preferred embodiment the annular shelf 50 extends outwardly from the body 41 beyond the flange 46 (as shown in FIGS. 2*a*–2*c*) so that the upper surface 52 functions as a stop for the child resistant closure 14 as described below.

Figure 2A:
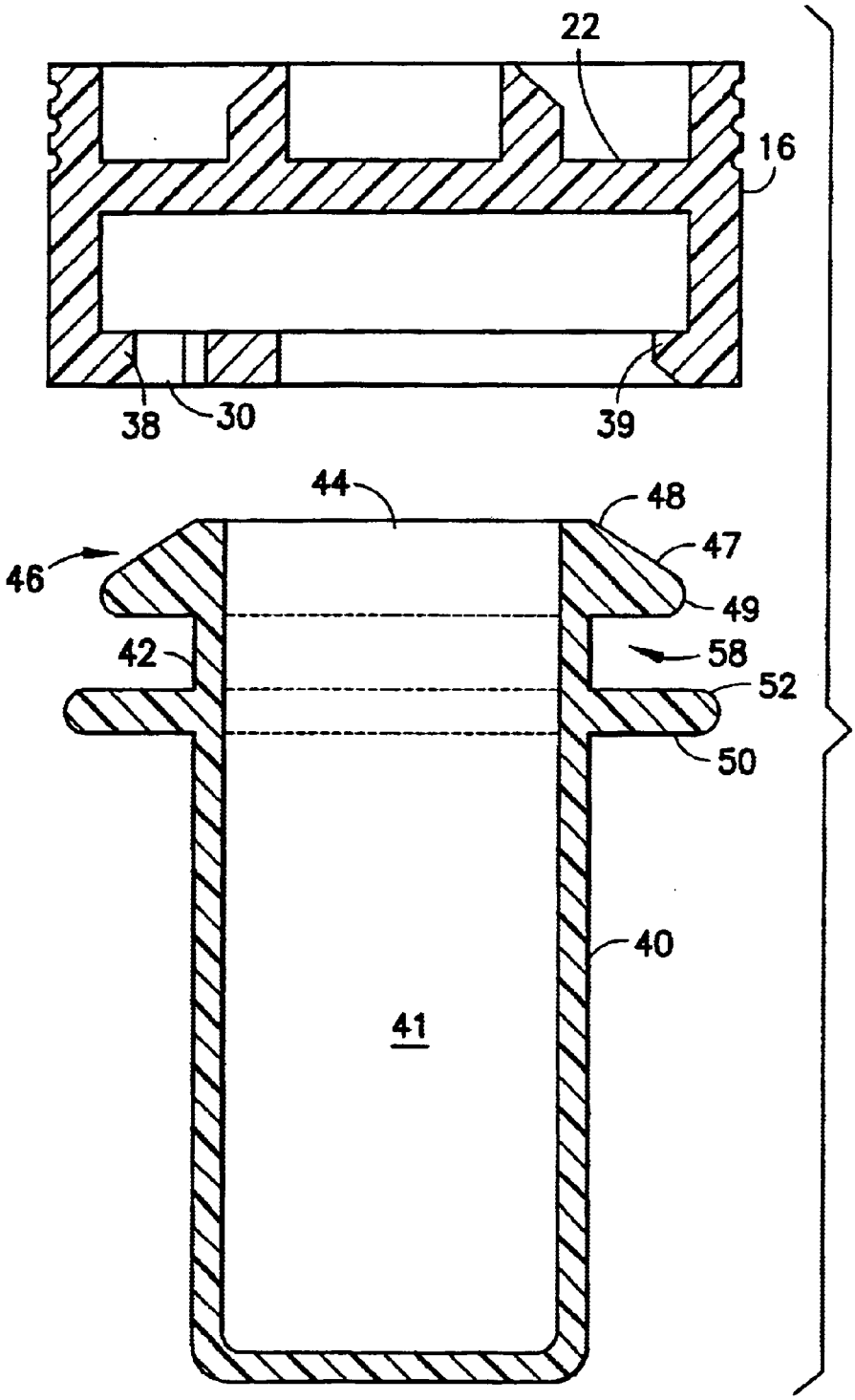
FIGS. 2*a*–2*c* depict cross-sectional views of different stages of engagement of a child resistant closure with the container.
Figure 2B:
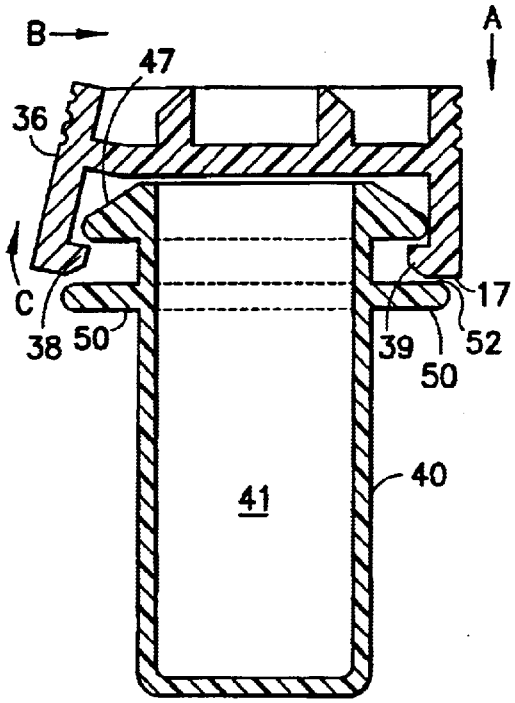
Figure 2C:
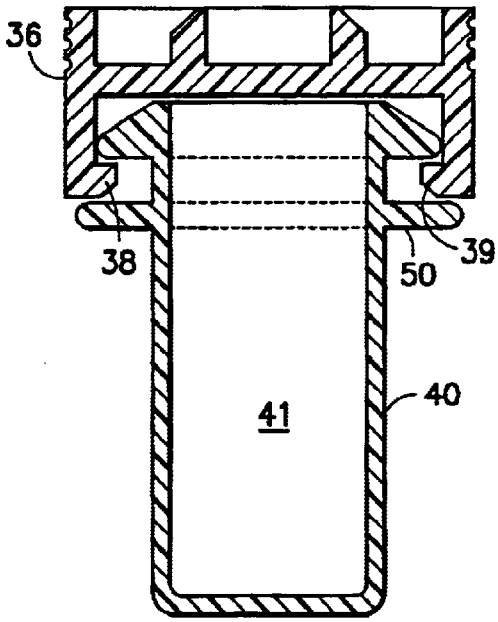

With reference now to FIGS. 2*a*–2*c*, the child resistant closure 12 is engaged with the container 40 by positioning the outer skirt 16 over the flange 46 and pressing downwardly as shown by directional arrow A. When force is applied, the tapered surface 47 urges tab 36 radially outwardly in a direction shown by arrow C until the tangs 38 and 39 clear the flange 46 whereupon the tangs snap back to their rest positions and become seated in the neck region 42 as shown in FIG. 2*c*. Once so positioned, the tangs engage the end 49 of flange 46 to "lock" the cap to the container, thereby preventing the contents from being readily accessed. As shown, in the locked position the first end 17 of the outer skirt seats against upper surface 52 of shelf 50. If the inner skirt 24 is included to that the engagement section is present, when the cap 10 is in the locked position, the flange 46 becomes seated in the engagement section 62.

To remove the child resistant closure 12, a force is applied to the tab 36, as by a thumb or forefinger, in a direction shown by arrow B for dislodging the tangs 38 from between the radial shelf 50 and the flange 46, whereupon an upwardly directed force separates the cap 10 from the container 40. More particularly, the design of the inventive cap provides the benefit of allowing single-handed operation because a user need only apply force against one area of the cap 10, i.e. against the tab 36, for removal of the cap from the container 40. Thus, to disengage the child safety closure 12 (i.e. the cap 10) from the container 40, a user can grasp the container in one hand and apply pressure to the tab 36 with the user's thumb of the grasping hand. This is illustrated in FIG. 6.

In the preferred embodiment, a visual indicator is provided on the outer surface of the tab 36 (as shown if FIG. 1) to identify the tab to a user, i.e., to allow a user to readily locate the tab. The visual indicator is preferably textured to provide a grip for further facilitating manipulation of the tab for disengaging the cap 10 from container 40.

Figure 4:
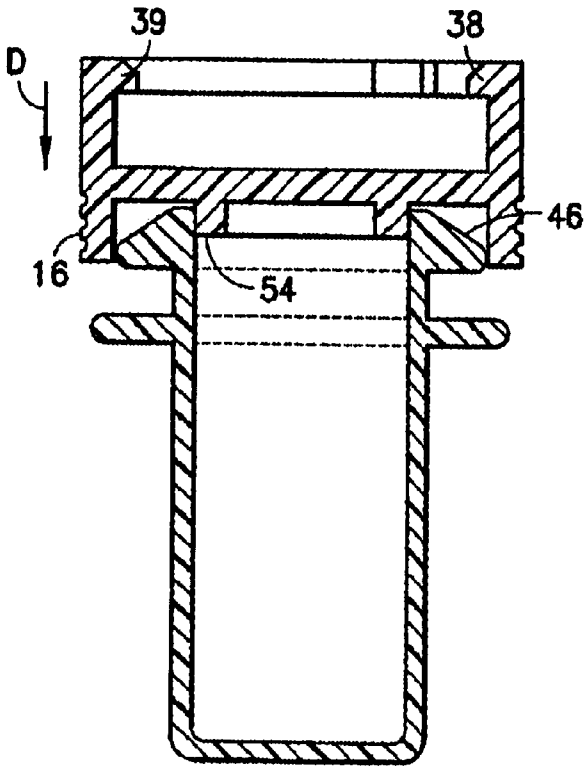
FIG. 4 illustrates a cross-sectional view of the non-child resistant closure engaged with the container.
Figure 3:
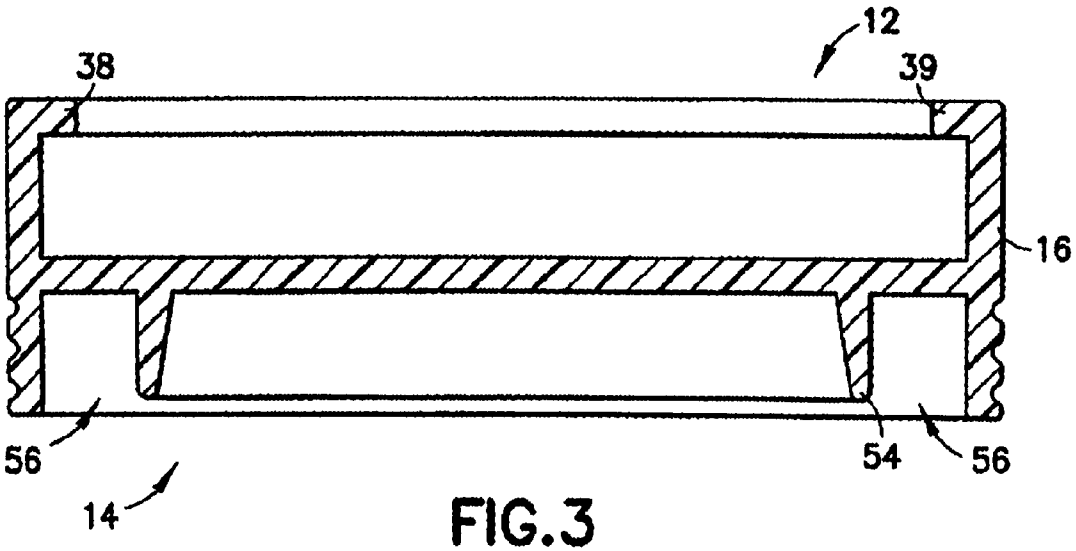
FIG. 3 depicts a cross-sectional view of a non-child resistant closure of the cap in accordance with the present invention.

Turning now to FIGS. 1*b*, 3 and 4, and as explained above, in addition to the child resistant closure 12, cap 10 preferably includes a non-child resistant closure 14. This closure includes an inner skirt 54 formed on the opposite side of dividing wall 22 and extending upwardly therefrom. Inner skirt 54 is radially displaced from the outer skirt 16 for defining an annular receiving area 56 therebetween. The width of the receiving area 56 is dimensioned for a friction fit with the flange 46 when the non-child resistant closure 14 is engaged with the container 40. More particularly, when the non-child resistant closure 14 of cap 10 is secured to container 40, the inner skirt 54 seats within the mouth 44 and the outer skirt 16 seats outside the edge 49 of flange 46. This allows the non-child resistant closure to be engaged with the container by simply pressing down on the cap 10 in a direction shown in FIG. 4 by arrow D. The cap can be likewise removed by pulling or pushing the cap in a direction opposite arrow D.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements which perform substantially the same function in substantially the same way to achieve the same results are within the scope of the invention. Moreover, it should be recognized that structures and/or elements shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A combination of a container and a reversible cap, comprising:

a container having a body, a neck connected to the body and defining a mouth at one end, and a radial flange proximate the mouth; and a reversible cap having a child resistant closure formed on a first side, and a non-child resistant closure formed on a second side, the reversible cap having;

a circular wall separating the child resistant closure from the non-child resistant closure;

an outer skirt bounding the circular wall, a portion of the outer skirt defining a tab having a first end and a second end, the tab being pivotally connected to one of the wall and the outer skirt to provide for outward radial movement of the first end relative to the outer skirt upon application of a force to the second end of the tab, the tab having a first tang movable therewith and mounted proximate the first end of the tab and extending radially inwardly;

a second tang mounted proximate an edge of the outer skirt on the first side of the cap substantially opposite the tab and extending radially inwardly, the first and second tangs being releasably engageable under the radial flange when the child resistant closure is positioned over the mouth and forced against the radial flange; and an inner skirt attached to the wall on the second side of the cap and radially displaced from and concentric with the outer skirt for defining an engagement region between the inner and outer skirts, the engagement region being dimensioned for a friction fit with the radial flange when the non-child resistant closure is positioned over the mouth and forced against the radial flange, the wall covering the mouth of the container when the child resistant closure on the first side of the cap is secured to the container and when the non-child resistant closure on the second side of the cap is secured to the closure wherein the first tang comprises a pair of tangs.

2. A combination of a container and a cap, comprising:

a container having a body, a neck connected to the body and defining a mouth at one end, and a radial flange proximate the mouth; and a cap having a circular wall, and an outer skirt bounding the circular wall for forming a child resistant closure on a first side of the wall, the outer skirt defining only a single tab having a first end and a second end, the tab being pivotally connected to one of the outer skirt and the wall to provide for outward radial movement of the first end of the tab relative to the outer skirt upon application of a force to the second end of the tab, the tab having a first tang movable therewith and mounted proximate the first end of the tab and extending radially inwardly a second tang mounted proximate an edge of the outer skirt on the first side of the wall substantially opposite the tab and extending radially inwardly, the first and second tangs being releasably engageable under the radial flange when the cap is positioned over the mouth and forced against the flange, the wall covering the mouth of the container when the cap is secured to the container.

3. The combination of claim 2, wherein the radial flange is tapered outwardly from top to bottom for facilitating coupling of the child resistant closure to the container.

4. The combination of claim 3, wherein an outer edge of the radial flange comprises an engagement lip for securing the first and second tangs to the container when the child resistant closure is positioned over the mouth and forced against the radial flange so that the first and second tangs clear the tapered region.

5. The combination of claim 2, wherein the outer skirt, wall and tab are integrally formed.

6. The combination of claim 5, wherein the first tang comprises a pair of tangs.

7. The combination of claim 2, wherein the container further comprises an annular shelf positioned on the neck and spaced below the flange for forming a receiving area between the flange and the annular shelf, the first and second tangs seating in the receiving area when the child resistant closure is positioned over the mouth and forced against the flange.

8. The combination of claim 2, wherein the cap further comprises a non-child resistant closure formed on a second side of the top wall, the non-child resistant closure comprising an inner skirt attached to the second side of the top wall and radially displaced from and concentric width the outer skirt for defining an engagement region between the inner and outer skirts, the engagement region being dimensioned for a friction fit with the flange when the non-child resistant closure is positioned over the mouth and forced against the flange.

9. A reversible cap having a first side for forming a child resistant enclosure with a container, and a second side for forming a non-child resistant enclosure with the container, the container being of the type having a body, a neck connected to the body and defining a mouth, at one end, and a radial flange proximate the mouth, the cap comprising:

a circular wall separating the child resistant closure from the non-child resistant closure;

an outer skirt bounding the circular wall, a portion of the outer skirt defining a tab having a first end and a second end, the tab being pivotally connected to one of the wall and the outer skirt to provide for outward radial movement of the first end relative to the outer skirt upon application of a force to the second end of the tab, the tab having a first tang movable therewith and mounted proximate the first end of the tab and extending radially inwardly;

a second tang mounted proximate an edge of the outer skirt on the first side of the cap substantially opposite the tab and extending radially inwardly, the first and second tangs being releasably engageable under the radial flange when the child resistant closure is positioned over the mouth and forced against the radial flange; and an inner skirt attached to the wall on a second side of the wall and radially displaced from and concentric with the outer skirt for defining an engagement region between the inner and outer skirts, the engagement region being dimensioned for a friction fit with the radial flange when the second side of the cap is positioned over the mouth and forced against the radial flange wherein the first tang comprises a pair of tangs.

10. A combination of a container and a reversible cap, comprising:

a container having a body, a neck connected to the body and defining a mouth at one end, and a radial flange proximate the mouth; and a reversible cap having a child resistant closure formed on a first side, and a non-child resistant closure formed on a second side, the reversible cap having;

a circular wall separating the child resistant closure from the non-child resistant closure;

an outer skirt bounding the circular wall, a portion of the outer skirt defining a tab having a first end and a second end, the tab being pivotally connected to one of the wall and the outer skirt to provide for outward radial movement of the first end relative to the outer skirt upon application of a force to the second end of the tab, the tab having a first tang movable therewith and mounted proximate the first end of the tab and extending radially inwardly;

a second tang mounted proximate an edge of the outer skirt on the first side of the cap substantially opposite the tab and extending radially inwardly, the first and second tangs being releasably engageable under the radial flange when the child resistant closure is positioned over the mouth and forced against the radial flange; and an inner skirt attached to the wall on the second side of the cap and radially displaced from and concentric with the outer skirt for defining an engagement region between the inner and outer skirts, the engagement region being dimensioned for a friction fit with the radial flange when the non-child resistant closure is positioned over the mouth and forced against the radial flange, the wall covering the mouth of the container when the child resistant closure on the first side of the cap is secured to the container and when the non-child resistant closure on the second side of the cap is secured to the closure, wherein the radial flange is tapered outwardly from top to bottom for facilitating coupling of the child resistant closure to the container, wherein the reversible cap further comprises an inner ring attached to an inner surface of the outer skirt and positioned on the first side of the cap in space relation from the second tang with the flange seating between the inner ring and the second tang when the child resistant closure is secured to the container.

* * * * *